US007362279B2

(12) United States Patent
Locatori

(10) Patent No.: US 7,362,279 B2
(45) Date of Patent: Apr. 22, 2008

(54) METHOD AND DEVICE FOR TV RECEIVING AND INTERNET TRANSRECEIVING ON A SATELLITE ANTENNA

(76) Inventor: Brunello Locatori, Viale Giovanni Pisano, 31, Pisa (IT) I-56123

( * ) Notice: Subject to any disclaimer, the term of this patent is extended or adjusted under 35 U.S.C. 154(b) by 20 days.

(21) Appl. No.: 10/596,962

(22) PCT Filed: Dec. 31, 2003

(86) PCT No.: PCT/IB03/06256

§ 371 (c)(1),
(2), (4) Date: Jun. 30, 2006

(87) PCT Pub. No.: WO2005/067099

PCT Pub. Date: Jul. 21, 2005

(65) Prior Publication Data

US 2007/0115195 A1 May 24, 2007

(51) Int. Cl.
*H01Q 13/00* (2006.01)

(52) U.S. Cl. ..... 343/786; 343/781 R

(58) Field of Classification Search ..... 343/776–779, 343/781 R, 781 P, 786
See application file for complete search history.

(56) References Cited

U.S. PATENT DOCUMENTS 4,207,573 A * 6/1980 Vignier ..... 343/727
4,504,836 A 3/1985 Seavey
6,020,859 A 2/2000 Kildal
6,512,485 B2 * 1/2003 Luly et al. ..... 343/781 CA
2001/0054984 A1 12/2001 Spirtus

FOREIGN PATENT DOCUMENTS

FR 1184652 A 7/1959
WO 03105358 A 12/2003

* cited by examiner

*Primary Examiner*—Hoang V Nguyen
(74) *Attorney, Agent, or Firm*—David A. Guerra

(57) ABSTRACT

A device for receiving satellite signals, associated to a parabolic dish (2) suitable for reflecting to a corresponding focus a first signal (25) at a first frequency and a second signal (35) at a second frequency. The device comprises a first feed (7,8) arranged near the focus suitable for transducing the first signal and transmitting it to a first receiver (9), a second feed (40,40*a*,40*b*) arranged hear the focus suitable for transducing the second signal (35,35*a*,35*b*) and transmitting it to a second receiver. The first frequency is dedicated to TV channels and the second frequency is at a band different from the first frequency and is dedicated to internet transmissions. The feeds can be of double reflection type, comprising a reflecting plate (7) that directs signals already reflected from the parabolic dish (2) towards a tubular wave guide (8) co-axial to the parabolic dish as well as towards a dipole (40) that constitutes the second feed. This way a simultaneous TV receiving and internet transreceiving on a same satellite antenna can be effected on a same satellite antenna using a single feed device.

11 Claims, 4 Drawing Sheets

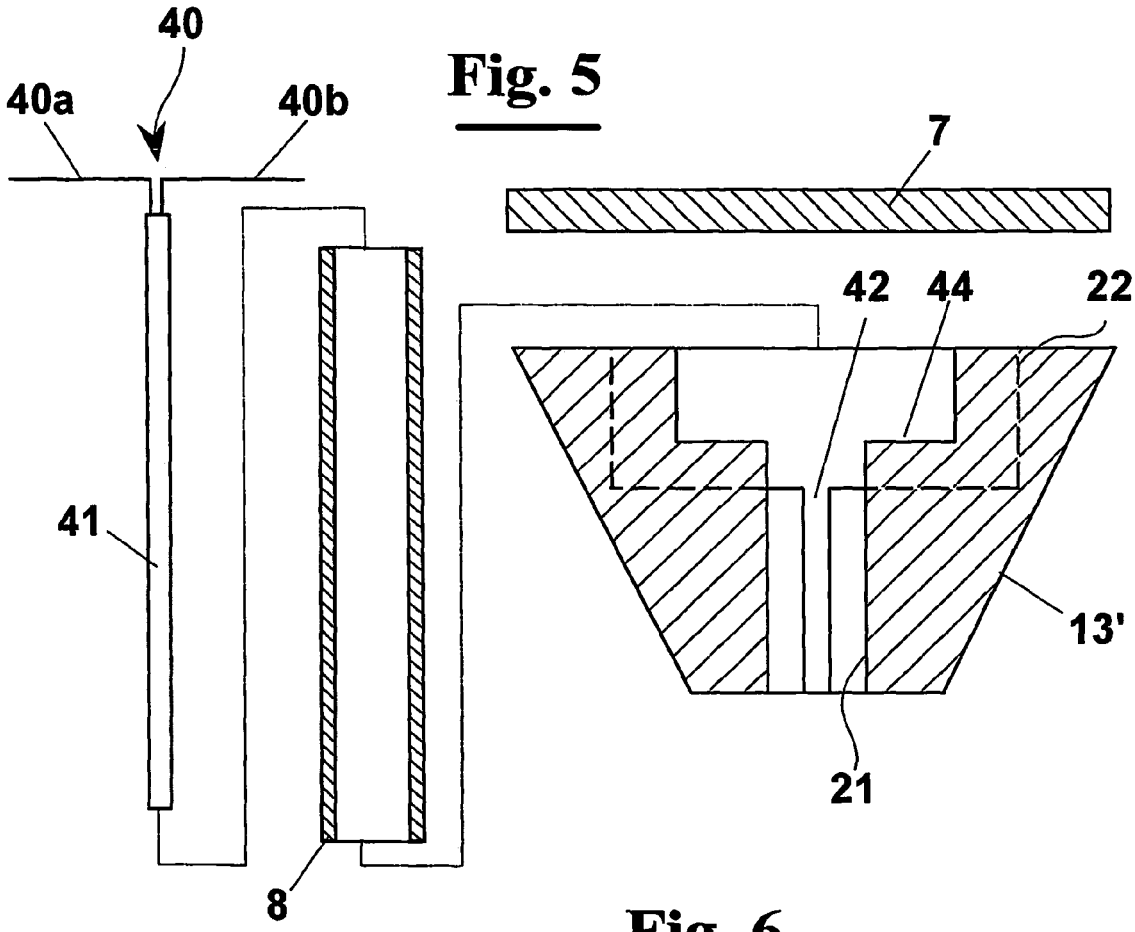
Fig. 5
Fig. 6
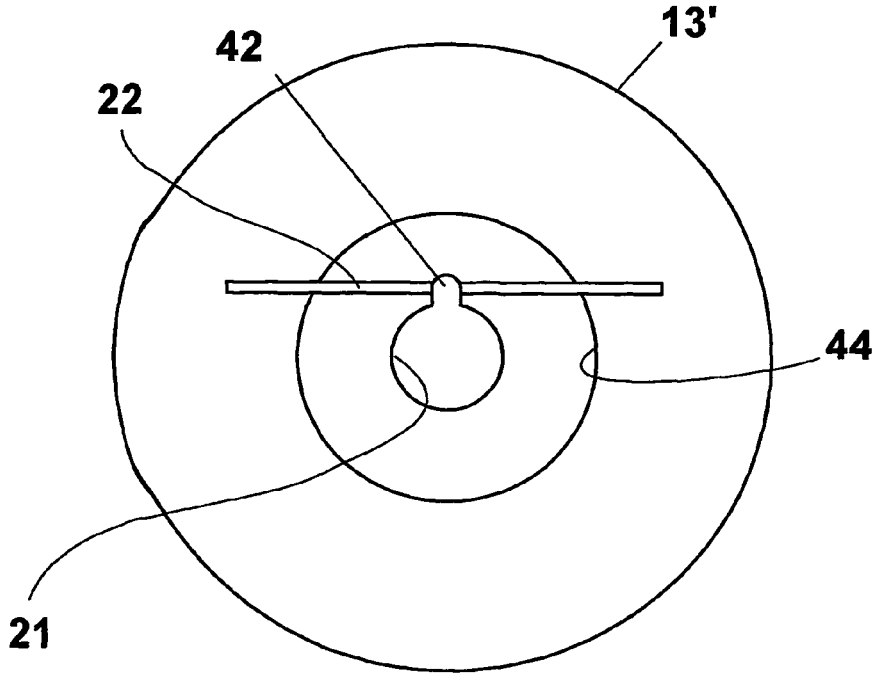

METHOD AND DEVICE FOR TV RECEIVING AND INTERNET TRANSRECEIVING ON A SATELLITE ANTENNA

CROSS-REFERENCE TO RELATED APPLICATIONS

This application is an U.S. national phase application under 35 U.S.C. §371 based upon co-pending International Application No. PCT/IB2003/006256 filed on Dec. 31, 2003. Additionally, this U.S. national phase application claims the benefit of priority of co-pending International Application No. PCT/IB2003/006256 filed on Dec. 31, 2003. The entire disclosures of the prior applications are incorporated herein by reference. The international application was published on Jul. 21, 2005 under Publication No. WO 2005/067099 A1.

The present invention relates to the field of antennas satellite and in particular it relates to a method for TV receiving and internet transreceiving on a satellite antenna Furthermore, the invention relates to a device to be mounted on a satellite antenna for carrying out this method.

BACKGROUND OF THE INVENTION

During sea navigation satellite communications allow to receive easily TV transmissions broadcast by many satellites.

A TV satellite antenna to be mounted on a watercraft normally comprises a parabolic dish and a "feed", i.e. a device that receives the signal reflected by the parabolic dish and transmits it to the TV decoder through a co-axial cable. In many antennas the feed consists of a device arranged at the focus of the parabolic dish and called LNB (Low Noise Block), where a reduction of the frequency for reducing the noise is carried out. Then, the signal reaches the TV decoder through a co-axial cable at a much lower frequency and easily transportable with limited losses.

At the wavelengths normally used in TV satellite transmissions, a parabolic dish with double reflection feed is also used, which comprises a reflecting plate, or mirror, which directs the signal already reflected by the parabolic dish towards a tubular wave guide, co-axial to the parabolic dish. The tubular wave-guide directs the signal towards an LNB converter and then to the TV decoder. The LNB converter is arranged behind the parabolic dish, and not in the focus of the parabolic dish, with the advantage of eliminating thus all the noise made by the circuits of the converter same Recently, some TV satellites have been equipped with transponders capable of assuring transmissions for allowing Internet surfing. For example, the satellites EUTELSAT and ASTRA in addition to broadcasting many TV channels, also give access to Internet. In fact, using a special electronic board a computer on a watercraft can download data (downlink) at a speed presently of 2 MBit/s. In this case signals directed to the satellite (uplink) are sent through a portable satellite telephone (or other system of communication towards satellite) at a much lower speed. Such system is called "unbalanced", owing to the large difference between the speeds of uplink and downlink.

In order to receive and transmit data via Internet in a "balanced" bidirectional way, it is therefore necessary, according to the present technique, a second transceiving antenna satellite. This causes higher costs and also problems of space on the watercrafts.

Alternatively, it is possible to use a satellite telephone, with increase of costs and low speed of data transmission.

Bringing on a same antenna a double TV/Internet communication causes, on the other hand, some technical problems. In fact, the TV satellite channels normally transmit on a band of about 12 GHz (KU-band: 10.7-12.7 GHz), whereas Internet communications are exchanged presently in L-band (about 1500-1600 MHz). Owing to the large difference of frequency, it is not possible with the present techniques use on a parabolic dish a same feed device.

SUMMARY OF THE INVENTION

It is therefore a feature of the present invention to provide a method that allows a simultaneous TV receiving and Internet transreceiving on a same satellite antenna.

It is another feature of the invention to provide a method that allows a simultaneous TV receiving and Internet transreceiving on a same satellite antenna.

It is another feature of the invention to provide a device for TV receiving and Internet transreceiving on a same satellite antenna using a single feed device.

It is another feature of the present invention to provide device that carries out this method.

It is a particular a feature of the invention to provide a single feed of double reflection type for satellite antennas that allows a simultaneous TV receiving and internet transreceiving.

In a first aspect of the invention a method for receiving satellite signals comprises the steps of:

- prearranging a parabolic dish suitable for reflecting to a corresponding focus a first signal at a first frequency and a second signal at a second frequency,
- prearranging near said focus a first feed suitable for transuding said first signal and transmitting it to a first receiver;
- prearranging near said focus a second feed suitable for transducing said second signal and transmitting it to a second receiver;
- wherein said first frequency is oriented to TV channels and said second frequency is at a band different from said first frequency and is oriented to internet transmissions.

In another aspect of the invention, a device for receiving satellite signals, associated to a parabolic dish suitable for reflecting to a corresponding focus a first signal at a first frequency and a second signal at a second frequency, comprises

- a first feed arranged near said focus suitable for transducing said first signal and transmitting it to a first receiver;
- a second feed arranged near said focus suitable for transducing said second signal and transmitting it to a second transceiver;
- wherein said first frequency is oriented to TV channels and said second frequency is at a band different from said first frequency and is oriented to internet transmissions.

Advantageously, said first feed is of double reflection type, comprising a reflecting plate that directs the signal already reflected from said parabolic dish sending it towards a tubular wave guide.

Preferably, said second feed comprises a dipole.

Preferably, said second feed is of double reflection type, comprising a reflecting plate that directs the signal already reflected from said parabolic dish sending it towards said dipole.

Preferably, said first feed and said second feed constitute an integrated feed with common reflecting plate.

Preferably, said dipole comprises two diverging terminals aligned along a line orthogonal to the axis of the parabolic dish. Advantageously, said line is external to said tubular wave-guide.

Advantageously, said integrated feed provides a body of permeable material to electromagnetic waves and that keeps physically together said reflecting plate, said dipole and said tubular wave-guide.

Preferably, said body of permeable material to electromagnetic waves comprises a central hole which houses said tubular wave guide, and a slit oriented according to a plane parallel to the axis of a central hole which houses said dipole.

In an alternative exemplary embodiment said second feed comprises two dipoles aligned according to lines spaced of 90° with respect to each other.

In an exemplary embodiment of the invention, if a TV signal that comes from a satellite with orbital position distant from the satellite from which comes a signal for Internet transreceiving, a third feed is provided arranged with axis oblique with respect to the axis of the parabolic dish. Said third feed can be driven for being oriented along a guide for receiving the signal pointing towards the orbital position of the sought satellite.

BRIEF DESCRIPTION OF THE DRAWINGS

Further characteristics and advantages of the present invention will be made clearer with the following description of possible exemplary embodiments, with reference to the attached drawings, in which like reference characters designate the same or similar parts, throughout the figures of which

FIG. 5 shows an exploded view of the integrated feed of FIG. 4;

FIG. 6 shows a top plan view of the body permeable to electromagnetic waves of the feed of FIG. 5;

DESCRIPTION OF A PREFERRED EXEMPLARY EMBODIMENT

Figure 1:
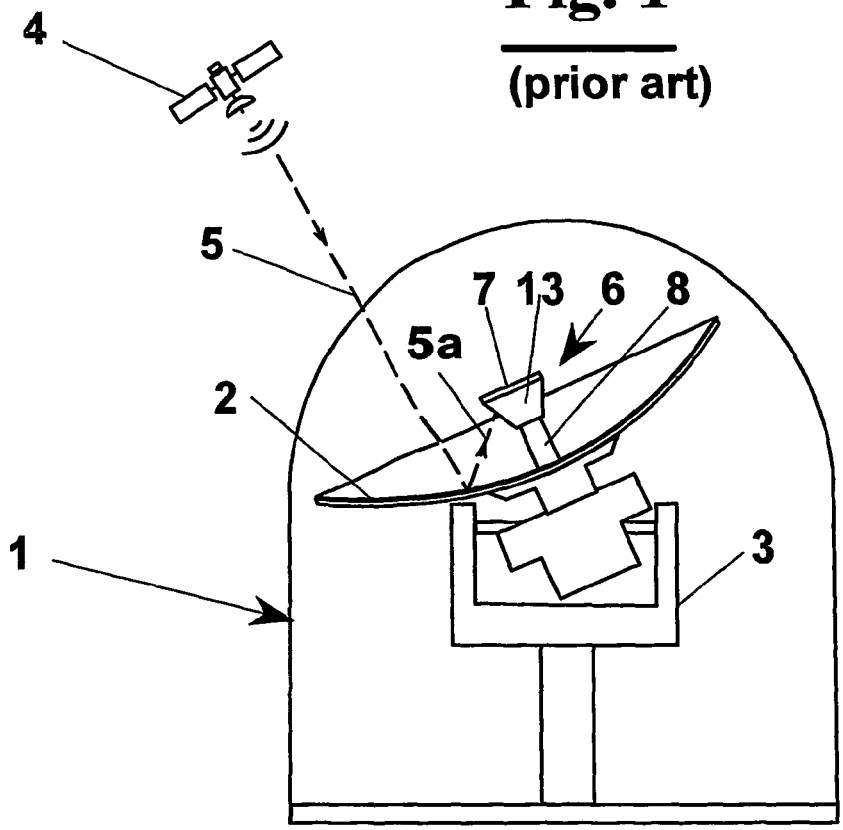
Fig. 1 (prior art)
FIG. 1 shows diagrammatically in an elevational side view a satellite antenna for watercrafts of prior art with parabolic dish and double reflection feed.

With reference to FIG. 1, a TV satellite antenna 1 of prior art, of the type normally used on watercrafts, comprises a parabolic dish 2 mounted on a support 3 capable of orienting it in order to point towards a satellite 4, thus orienting itself with axis parallel to the direction from which a TV signal 5 comes, for example in KU band. In the centre of the parabolic dish 2 a "feed" 6 is arranged that receives the reflection 5*a* of the signal 5 transmitted by satellite 4.

Figure 2:
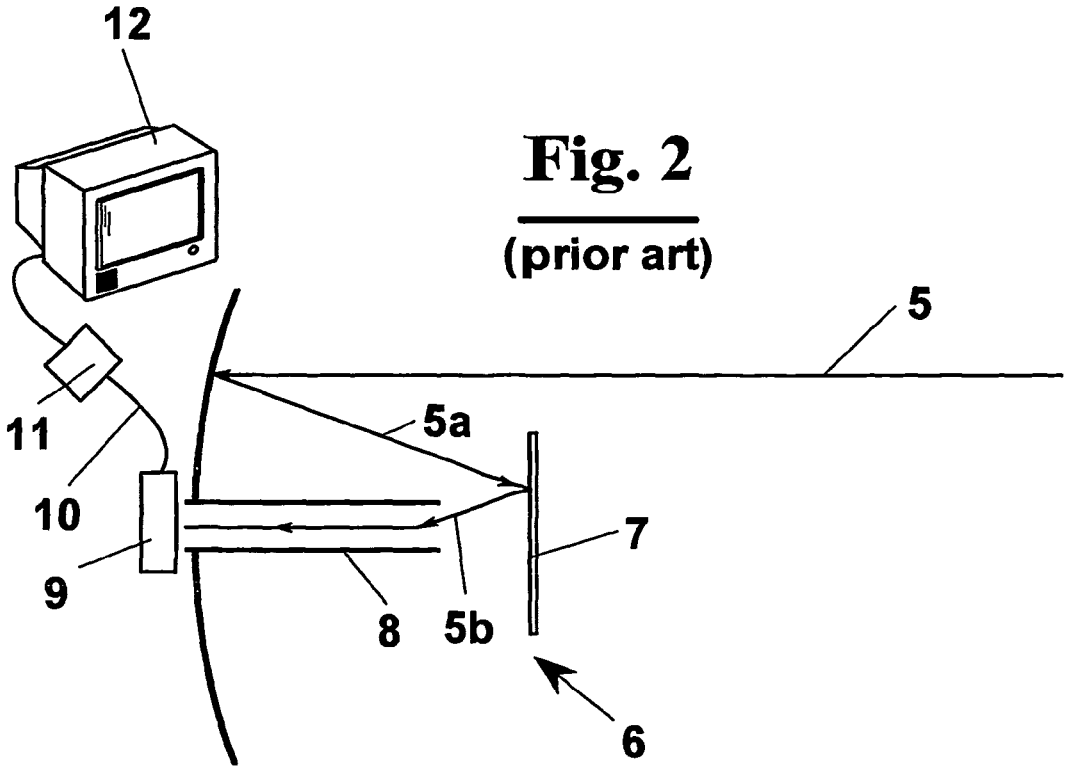
Fig. 2 (prior art)
FIG. 2 shows diagrammatically the mechanism of double reflection feed of FIG. 1 associated to the parabolic dish, with tubular wave guide.

The diagrammatical view of the known way of operation of the "feed" 6 is indicated in FIG. 2. The wave 5*a* reflected by parabolic dish of signal 5 reaches a reflecting plate 7, or mirror, and is reflected in 5*b* addressed towards a tubular wave-guide 8 co-axial to the parabolic dish 2. Tubular wave guide 8 directs the signal towards an LNB converter 9 (Low Noise Block) where a reduction of the frequency is carried out. Then, the signal at reduced frequency reaches through a co-axial cable 10 the TV decoder 11 and then, suitably decoded, a TV set 12.

A "feed" of this type is said "double reflection" feed and is suitable for receiving TV satellite transmissions. Reflecting plate 7 and tubular wave guide 8 are kept together by a body 13 made of a material permeable to electromagnetic waves, normally polystyrene foam.

Figure 3:
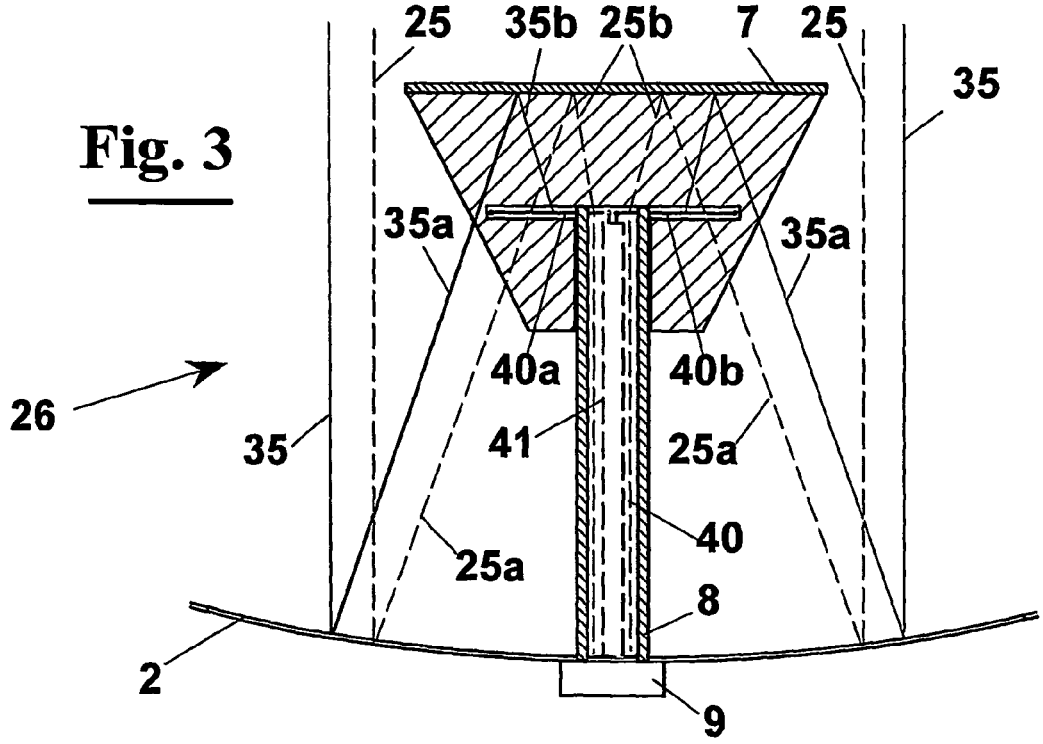
FIG. 3 shows an antenna according to the invention.

With reference to FIG. 3, according to the present invention, in case a satellite transmits both a TV signal 25 and an internet signal 35, for example a L-band signal, an integrated feed 26 is provided suitable for being associated to a parabolic dish 22 for reflecting the first signal 25 at a first frequency and the second signal 35 at a second frequency respectively as 25*a* and 35*a* towards the focus of the parabolic dish.

Integrated feed 26 comprises:

- a first feed 6 with a reflecting plate 7 arranged near the focus and suitable for reflecting to 25*b* the signal 25, 25*a*, sending it to block 9 through tubular wave guide 8, as known in the art, with reflecting plate 7 integral to tubular wave guide 8 by means of body 13 transparent to electromagnetic waves;
- a second feed comprising a dipole 40 immersed in body 13, capable of receiving the reflection 35*b* of signal 35, 35*a* from the reflecting plate 7, sending it to a second receiver through a co-axial cable 41.

In this way the same reflecting plate 7 is exploited both for first feed 6 and for second feed 40 as a single integrated feed 26.

Dipole 40, which constitutes the second feed, comprises two diverging terminals 40*a* and 40*b* aligned along a line orthogonal to the axis of the parabolic dish 2 and external to the tubular wave-guide 8.

Figure 4:
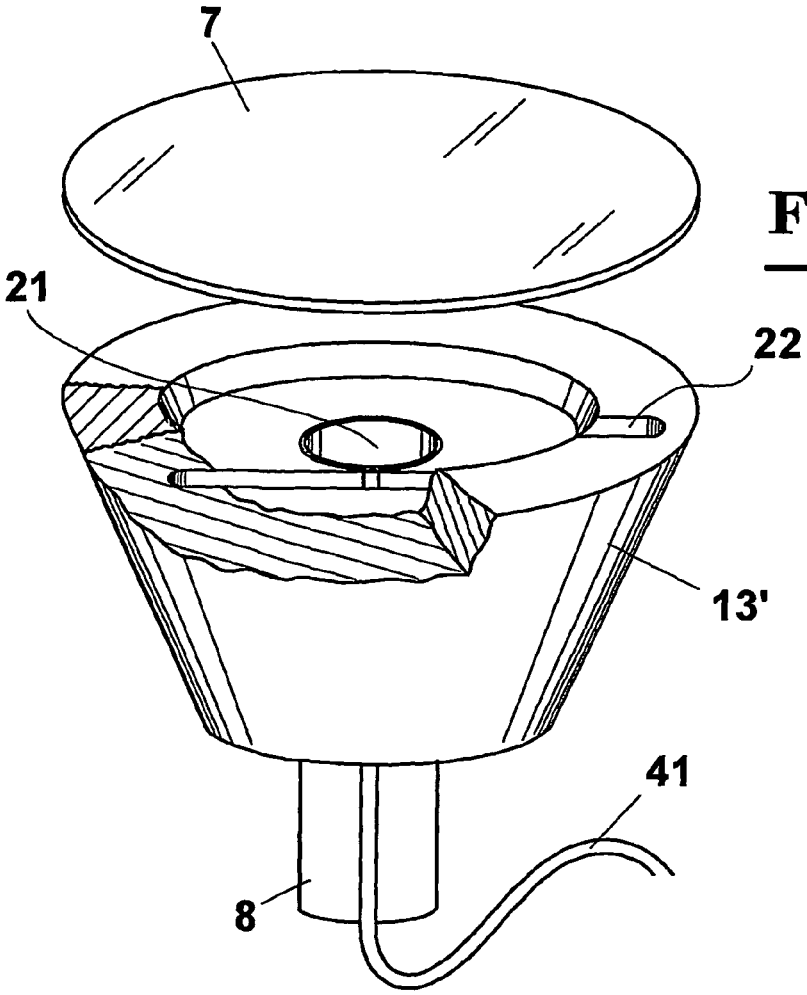
FIG. 4 shows a perspective exploded partially cross sectioned view of an integrated feed similar to that of FIG. 3.

With reference to FIGS. 4, 5 and 6 a special body 13' of permeable material to electromagnetic waves can be provided that keeps physically together reflecting plate 7, dipole 40 and tubular wave guide 8. It comprises a central hole 21 which houses said tubular wave guide 8, and a slit 22, which houses the dipole 40 and is made in body 13' according to a plane parallel to the axis of central hole 21. A central conical hole 44 is also made for making body 13' the most permeable possible to the path of reflected waves 25*b* towards tubular wave guide 8, which is housed in hole 21. Furthermore, a hole 42 is provided for moving the co-axial cable 41 of the dipole 40.

This way, coexistence is possible in a same space of two systems that do not influence each other and that are capable of receiving two frequency bands very different from each other. Therefore, both linearly polarised waves, i.e. laying in a determined plane of the space, used in many types of radio transmissions, and circularly polarised waves, i.e. that are spread following a left of right spiral, can thus be transmitted and received.

Further to the advantage of having a single feed for two functions, another advantage is that dipole 40 can be used for both the "downlink" from satellite to antenna, and the "uplink" from antenna to satellite, in both cases at a high speed of connection.

Figure 7:
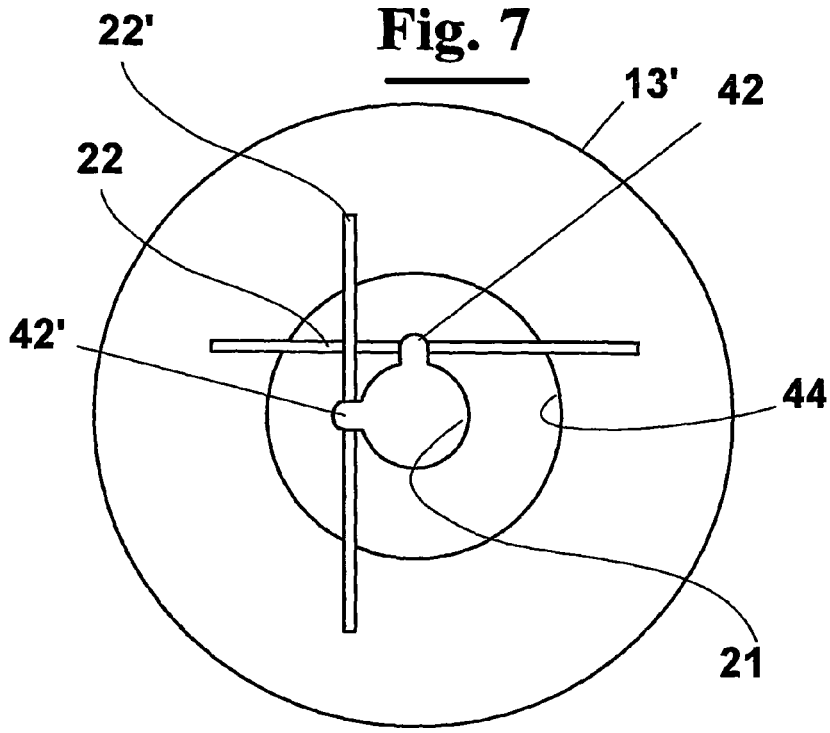
FIG. 7 shows a top plan view of an exemplary embodiment of the body permeable to electromagnetic waves of FIG. 5.

In a possible exemplary embodiment, shown in FIG. 7, body 13' can house, in respective slits 22 and 22', two dipoles 40 spaced of 90° with respect to each other, allowing of transmitting and receiving in L-band two different frequencies at the same time, polarised in respective orthogonal planes. In this case two holes 42 and 42' are provided for housing the coaxial cables of the two dipoles outside of tubular wave-guide 8, which in turn is housed in hole 21.

Figure 8:
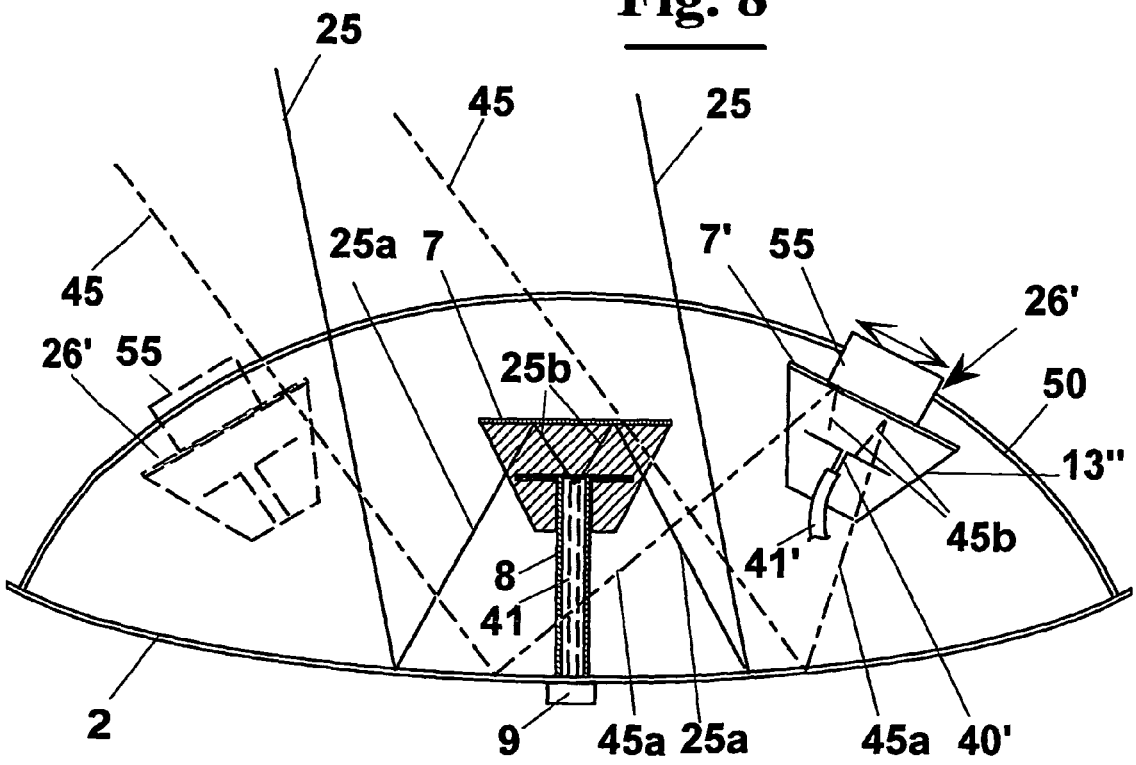
FIG. 8 shows an exemplary embodiment of an antenna according to the invention, with a second feed movable for simultaneous transreceiving with two satellites.

With reference to FIG. 8, if the sought TV signal 25 is on a satellite with orbital position distant from the satellite from which comes a signal 45 for Internet transreceiving, it is possible, according to the invention, to arrange a third feed 26' having axis oblique with respect to the axis of the parabolic dish 2. The additional feed can be either fixed or driven at 55, as shown in FIG. 8, along a guide 50 for receiving the signal pointing towards the orbital position of the sought satellite. It has a body 13" similar to that shown in FIGS. 5 and 6, and a plate 7' for reflecting as 45*b* the signal 45, 45*a* reflected by the parabolic dish 2.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. A device for receiving satellite signals, associated to a parabolic dish suitable for reflecting to a corresponding focus a first signal at a first frequency and a second signal at a second frequency, comprising: a first feed arranged near said focus suitable for transducing said first signal and transmitting it to a first receiver; and a second feed arranged near said focus suitable for transducing said second signal and transmitting it to a second receiver; wherein said first frequency is dedicated to TV channels and said second frequency is at a band different from said first frequency and is dedicated to internet transmissions; wherein said first feed is of double reflection type, comprising a reflecting plate that directs signals already reflected from said parabolic dish towards a tubular wave guide co-axial to the parabolic dish.

2. The device according to claim 1, wherein said second feed comprises a dipole.

3. The device according to claim 2, wherein said second feed is of double reflection type, comprising a reflecting plate that directs signals already reflected from said parabolic dish towards said dipole.

4. The device according to claim 2, wherein said dipole comprises two diverging terminals aligned along a line orthogonal to the axis of the parabolic dish and external to said tubular wave guide.

5. The device according to claim 2, wherein said dipole comprises two dipoles spaced at 90° with respect to each other.

6. The device according to claim 2, wherein, in case a TV signal is sought that comes from a satellite with orbital position distant from the satellite from which comes a signal for Internet transreceiving, a third feed is provided arranged with axis oblique with respect to the axis of the parabolic dish.

7. The device according to claim 6, wherein said third feed is driven for being oriented along a guide for receiving the signal pointing towards the orbital position of the sought satellite.

8. The device according to claim 1, wherein said first feed and said second feed constitute an integrated feed with common reflecting plate.

9. The device according to claim 8, wherein said integrated feed provides a body made of material permeable to electromagnetic waves and that keeps physically together said reflecting plate, said dipole and said tubular wave guide.

10. The device according to claim 9, wherein said body of permeable material to electromagnetic waves comprises a central hole which houses said tubular wave guide, and a slit oriented according to a plane parallel to the axis of a central hole which houses said dipole.

11. A method for receiving satellite signals comprising the steps of: prearranging a parabolic dish suitable for reflecting to a corresponding focus a first signal at a first frequency and a second signal at a second frequency, prearranging near said focus a first feed suitable for transducing said first signal and transmitting it to a first receiver; prearranging near said focus a second feed suitable for transducing said second signal and transmitting it to a second receiver, wherein said first frequency is dedicated to TV channels and said second frequency is at a band different from said first frequency and is dedicated to internet transmissions said first and second feed being executed according to any of the previous claims; wherein said first feed is of double reflection type, comprising a reflecting plate that directs signals already reflected from said parabolic dish towards a tubular wave guide co-axial to the parabolic dish.

* * * * *